US005755000A

United States Patent [19]

Thompson

[11] Patent Number: 5,755,000

[45] Date of Patent: May 26, 1998

[54] LOW AIR-LOSS MATTRESSES

[75] Inventor: Martin Stuart Thompson, Kent, England

[73] Assignee: Egerton Hospital Equipment Limited, Kent, England

[21] Appl. No.: 750,383

[22] PCT Filed: May 25, 1995

[86] PCT No.: PCT/GB95/01192

§ 371 Date: Mar. 19, 1997

§ 102(e) Date: Mar. 19, 1997

[87] PCT Pub. No.: WO95/31920

PCT Pub. Date: Nov. 30, 1995

[30] Foreign Application Priority Data

May 25, 1994 [GB] United Kingdom ..... 9410489

[51] Int. Cl.[6] ..... A47C 27/10; A61G 7/057

[52] U.S. Cl. ..... 5/713; 5/714

[58] Field of Search ..... 5/713, 714, 710

[56] References Cited

U.S. PATENT DOCUMENTS

| | | | |
|---|---|---|---|
| 3,678,520 | 7/1972 | Evans | 5/710 |
| 4,525,885 | 7/1985 | Hunt et al. | 5/713 |
| 4,797,962 | 1/1989 | Goode | 5/713 |
| 4,995,124 | 2/1991 | Wridge, Jr. et al. . | |
| 5,396,671 | 3/1995 | Stacy | 5/713 |
| 5,634,225 | 6/1997 | Miller, Sr. et al. | 5/713 |

FOREIGN PATENT DOCUMENTS

| | | |
|---|---|---|
| 0260087 | 3/1988 | European Pat. Off. . |
| 2083865 | 12/1971 | France . |
| 3320771 | 12/1984 | Germany . |

*Primary Examiner*—Alexander Grosz
*Attorney, Agent, or Firm*—Kinney & Lange, P.A.

[57] ABSTRACT

A low air-loss mattress comprises a containment envelope enclosing two lengthwise extending inflatable side chambers each connected to receive air under pressure from a source and each connected to supply such air under pressure to one or more laterally extending inflatable air sacks positioned between the two side chambers. Each air sack is formed with a multiplicity of holes through which air can leave the mattress.

6 Claims, 3 Drawing Sheets

LOW AIR-LOSS MATTRESSES

BACKGROUND OF THE INVENTION

This invention relates to low air-loss mattresses and beds therefor.

Low air-loss beds and mattresses are known which essentially consist of a containment envelope of air permeable waterproofed material supplied with air under pressure and formed with a multiplicity of discrete holes through which air can leave the mattress. Such beds and mattresses are used in the treatment of patients at risk to the onset of skin maceration and the formation of pressure ulcers.

It has been found with known air-loss beds that patients are at risks of falling particularly when getting onto and off from the bed. Also many air-loss systems have limited facility for providing a profiled air pressure along the mattress length and for selectively changing the pressure of air within the mattress ad automatically maintaining that selected air pressure.

It is also the case that in some air loss mattresses there is no provision for being able to measure the pressure within the mattress in different areas so as to provide the benefit of variable pressures within the mattress.

SUMMARY OF THE INVENTION

The present invention sets out in one aspect to provide a low air-loss mattress which includes additional safeguards against a patient falling and, in another aspect, a control system for selectively varying and automatically maintaining a selected air pressure within the mattress.

According to the present invention in one aspect there is provided a low air-loss mattress which comprises a containment envelope enclosing two inflatable side chambers of an air impervious material extending lengthwise of the mattress and each connected through a releasable connector to receive air under pressure from a source and connected to supply such air under pressure to a plurality of side-by-side inflatable air sacks of a permeable material extending laterally of the mattress and between the two side chambers, the arrangement being such that, when inflated, the upper surface of each side chamber lies at or above the upper surface of the air sacks.

In a preferred arrangement, alternate air sacks are connected to receive air under pressure from one side chamber, the other air sacks being connected to receive air under pressure from the other side chamber. Each releasable connector may include a restricted orifice which operates to regulate the flow of air to the respective air sack and the pressure of air within that air sack.

Means may be provided to retain the air sacks in side-by-side relation. This means may comprise a containment envelope for the air sacks which comprises upper and lower sheets joined together by a plurality of transverse partitions to define elongate pockets into each of which one of the air sacks is positioned. Other retention means may be employed, these including a series of straps attached to a lower sheet which define loops into each of which one of the air sacks can be positioned.

Each side chamber may be supplied with air under pressure through a manifold conduit located within the containment envelope and including connectors attachable to inlet connections of the two side chambers. The connectors may comprise push fit connectors. Other forms of connectors may however be employed.

Means may be provided for interrupting sequentially the supply of air under pressure to the two side chambers thereby alternately to increase and decrease the pressure in each of the side chambers. This operation will result in an alternating pressure listing between the air sacks being supplied with air by the respective chambers. Thus, each side chamber may be independently supplied with air under pressure, these supplies being sequentially controlled as described.

The manifold conduit may be connected to the source of air under pressure through control apparatus including a microprocessor which operates selectively to vary the pressure of air supplied to the manifold and/or to maintain within the mattress a required air pressure.

Thus the pressure of air within the manifold and/or one or both side chambers may be measured and relayed to the control apparatus, the latter effecting an increase or decrease in air pressure in response to a detected difference between the selected and measured values.

The control apparatus may operate to vary a selected pressure by pre-sat percentages in response to a patient sitting up or lying an one side. The control apparatus may also be operable to supply on demand a maximum air pressure to the mattress to provide a firm setting for, for example, physiotherapy. The control apparatus may also be operable to deflate the mattress by sucking air from its Interior in response, for example, to a need for cardio pulmonary resuscitation. Furthermore the control apparatus may operate to sound or display alarm automatically in the event off for example, a loss or air pressure or electrical supply.

In another aspect, there is provided a low air-loss mattress which includes two lengthwise extending inflatable side chambers of an impervious material each connected to receive air under pressure from a source and each connected to supply such air to alternate ones of a plurality of inflatable air sacks of a permeable material which extend laterally between the side chambers.

Each side chamber may extend along the entire length of the mattress or a part thereof. There may, therefore, be two or more individual inflatable side chambers extending along each side of the mattress, each such side chamber being connected to the same source of air under pressure or to two or more different such sources.

BRIEF DESCRIPTION OF THE DRAWINGS

The invention will now be described by way of example only with reference to the accompanying diagrammatic drawings in which.

DETAILED DESCRIPTION OF THE PREFERRED EMBODIMENTS

Figure 1:
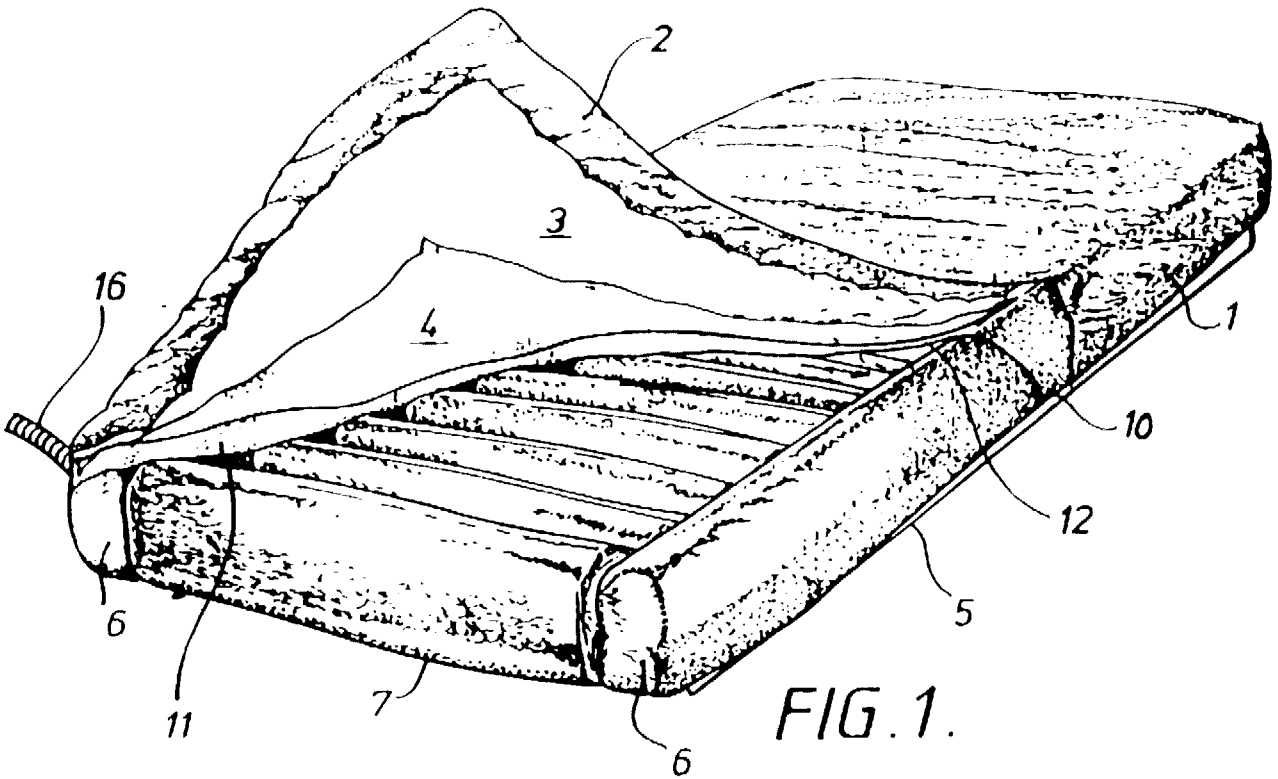
FIG. 1 is a perspective view of a mattress in accordance with the invention with its containment, envelope partially removed.
Figure 3:
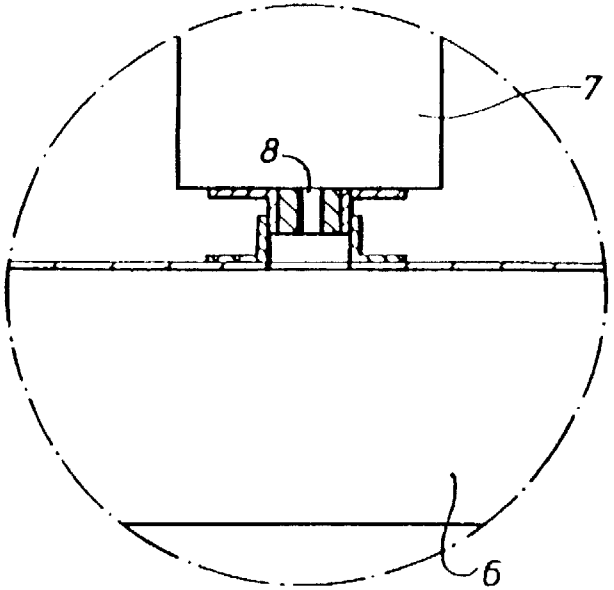
FIG. 3 is a section to an enlarged scale of a releasable connection between a side chamber and an air sack of the mattress disclosed in FIG. 1.
Figure 2:
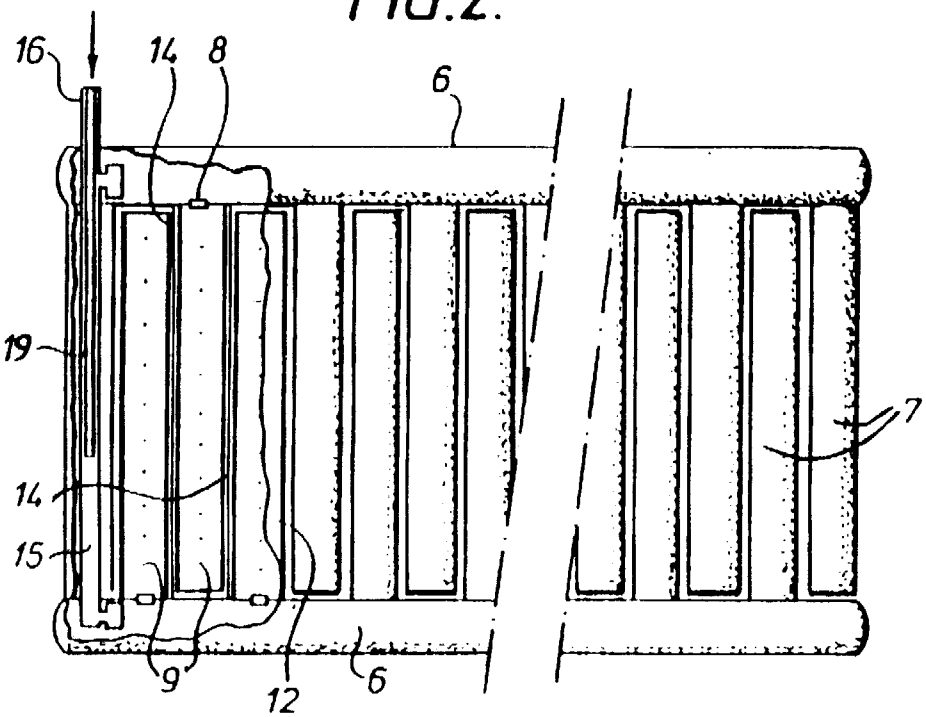
FIG. 2 is a plan view from above partly in section of the low air-loss mattress shown in FIG. 1 with its containment envelope removed.
Figure 4:
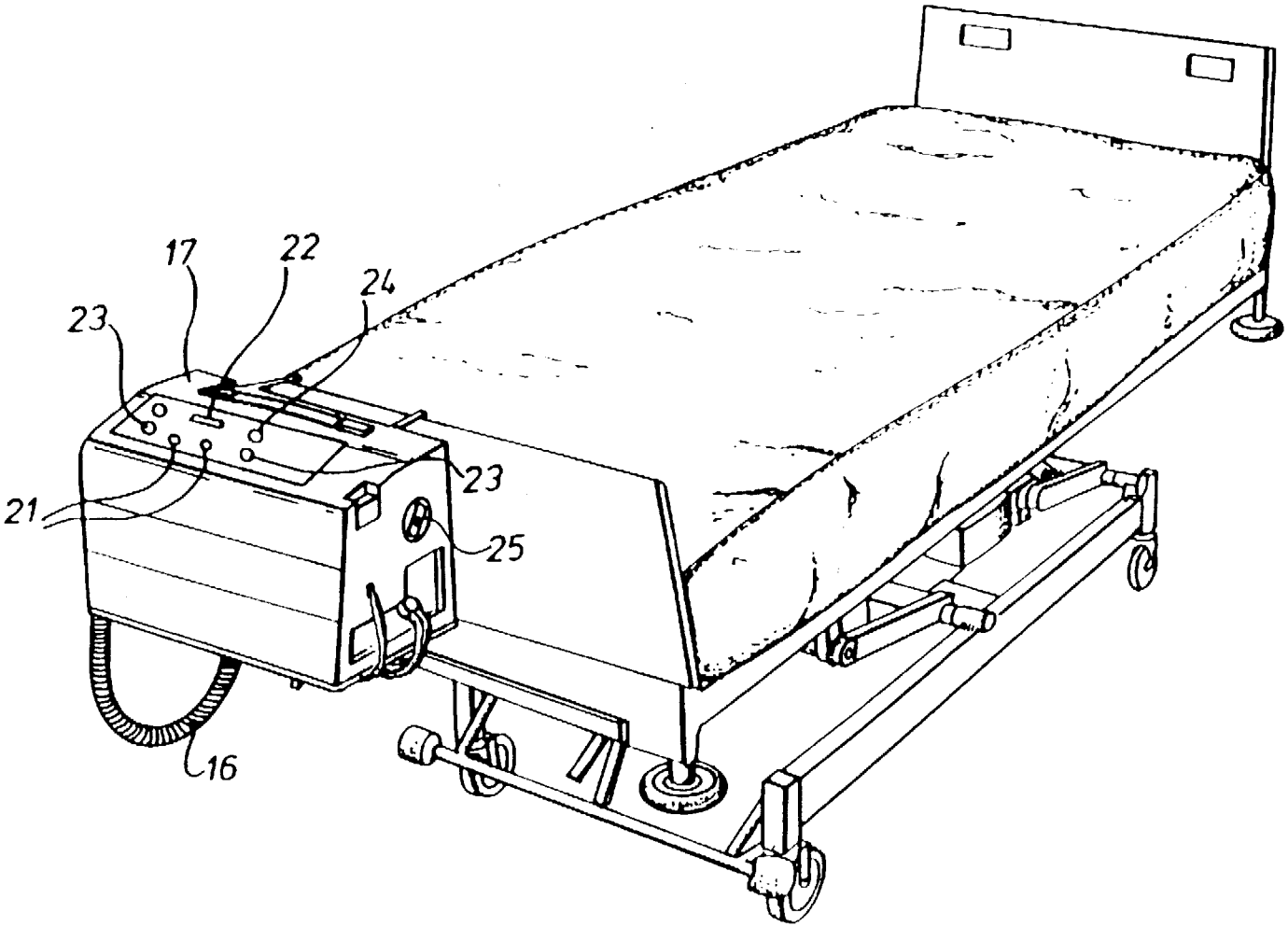
FIG. 4 is a perspective view of a hospital or therapeutic bed fitted with a micro-processor driven control apparatus for use with the low air-loss mattress illustrated in FIGS. 1 and 2.

The low air-loss mattress illustrated in FIGS. 1 to 3 comprises a quilted containment envelope which includes an outer layer 1 of, for example, an ultra soft NYLON fabric to minimise skim friction and to aid pressure distribution, a second layer 2 of, for example, breathable urethane 2 to provide a barrier to liquids and bacteria whilst permitting the passage of vapor, a third layer 3 of, for example, DACRON fibre fill to promote osmotic action of urethane and to encourage the dispersal of vapour through a wicking action and a fourth layer 4 of air permeable fabric to reduce friction and to assist in the dispersal of vapour.

The envelope has a integral foam underlay 5 to prevent a patient being at risk during transportation or in the event of a power failure.

Contained within the envelope is an assembly of two lengthwise extending inflatable side chambers 6 and a multiplicity of lateral air sacks 7. Typically eighteen air sacks are provided in a mattress for use by adults. Other numbers of air sacks could however be employed. As will be seen from FIG. 3, the air sacks 7 are connected to the side chambers 6 through releasable connectors having restricted orifices 8 whose diameters may vary along the length of the mattress to provide a profiled air pressure. Thus the orifices may be selected to provide a firmer pillow area and a softer heel area. As will be seen from FIG. 2, alternate air sacks are connected to one of the side chambers with the interposing air sacks being connected to the other side chamber. Each air sack is produced from a permeable material having a multiplicity of holes 9 through which air can leave the mattress.

The air sacks 7 are positioned one within each of a plurality of open-end-distally extending pockets 10 formed in a retaining cover 11. The pockets 10 are formed between upper and lower sheets 12 of the cover 11 and length of material 14 secured to these sheets.

Each side chamber is connected to receive air under pressure from a common source via a manifold conduit 15. This conduit is in turn connected to receive air under pressure through am outlet pipe 16 of a microprocessor driven controller 17. This controller will be described in greater detail below with reference to FIG. 3 of the drawings.

In an alternative arrangement, two outlet pipes 16 are provided, each being connected to supply air under pressure to one of the side chambers. Switching means may be provided sequentially to increase and decrease the supply of air to the two chambers in an alternating sense to produce an alternating pressure system, for the mattress The manifold conduit is includes a pair of male or female connectors attachable to complementary connectors of the side chambers 6. The side clambers are produced from an impervious material and are consequently each at a higher pressure than that of the air sacks 7. When inflated, the upper surface of each side chamber lies at the level of or slightly above the air sacks 7.

In use, the several air pressure sacks 7 are supplied with air under pressure from the side chambers 6, this air replenishing the air which is constantly leaving the sacks 7 through the holes 9. The pressure of air within the individual sacks may differ depending upon the size of orifices 8 employed. The side chambers 6 are in turn supplied which air under pressure from the manifold 15. Because, a mentioned previously, the side chamber, 7 are in use subjected to higher air pressures than that within the air sacks, they operate to provide a firm edge to each mattress side to provide support to a patient when getting onto and off from the mattress. Also, these side chambers tend to cradle the patient to give a feeling of support.

As mentioned previously, the manifold conduit 15 is connected to receive air under pressure via a microprocessor driver controller. This controller 17 is illustrated in FIG. 3 and is positioned between the source of air pressure (e.g. a pump) and the mattress to be supplied.

For any give patient at-risk to pressure ulcers it is important that the pressure of air within the mattress is set at a value appropriate to the needs of the patient. It is also extremely important that, once selected, this pressure is not only maintained but is seen to be maintained. To achieve this objective, a open-ended flexible tube 19 is connected at one end to a pressure sensitive diaphragm or the like within the controller 17 and passes trough the outset pipe 16 to a position conveniently midway along the length of the manifold conduit 15 or, if required, to positions within one or each side chamber. Alternatively, the free end of the tube 19 may be positioned within the pipe 16 and not pass into the mattress. The pressure sensitive tube 19 relays to the controller 17 the actual pressure supplied to or within the mattress and activates a comparator of the microprocessor to increase or decrease the flow of air to the mattress through the pipe 16 in the event that the required pressure differs from the measured pressure.

The required pressure is sat by touch pads 21 on a control panel of the controller, one operating to increase the pressure and the other to decrease the pressure. The set pressure is displayed on a display 22. This display may take the form of a simple segmental coloured line whose length increases or decreases with pressure; other forms of display may, however, be employed.

The control panel af the controller 17 also includes touch pads 23 to adjust the mattress pressure by preselected percentages for patients who are sitting up or lying on one side. An additional touch pad 24 is operated immediately to maximise the pressure within the mattress to provide a firm setting for, for example, physiotherapy. The controller further includes an audio and/or visual alarm which operates in the event, for example, a loss of air pressure or electrical power. Furthermore, the controller provides a switch 25, which is operated rapidly to deflate the mattress by sucking air from the mattress for purposes of, for example, cardio pulmonary resuscitation.

The microprocessor driven controller may either be freestanding, may be provided with clips for positioning on a therapeutic bed or may be formed internally with the bed, the control panel forming part of, for example, the head or foot rest of a bed. This latter construction enables a standard bed to be employed which is capable or receiving a variety of different low air-loss mattresses.

It will be appreciated that the foregoing is merely exemplary of low air-loss mattresses and therapeutic beds therefor in accordance with the invention and that modifications can be readily be made thereto without departing from the true scope of the invention as set out in the appended claims.

I claim:

1. A low air-loss mattress which comprises two inflatable side chambers of an impervious material extending lengthwise of the mattress and each connected to receive air under pressure from a source and connected to supply such air under pressure to a plurality of side-by-side inflatable air sacks of a permeable material which extend laterally of the mattress and between the two side chambers, the mattress being characterised in that the inflatable side chambers and air sacks are connected through releasable connectors and are enclosed within a containment envelope with alternate air sacks connected to receive air under pressure only from one side chamber and the other air sacks connected to receive air under pressure only from the other side chamber.

the arrangement being such that, when inflated, the upper surface of each side chamber lies at or above the upper surface of the air sacks.

2. A mattress as claimed in claim 1 wherein each releasable connector includes a restricted orifice.

3. A mattress as claimed in claim 1 wherein each side chamber is supplied with air under pressure through a manifold conduit located within the containment envelope and including connectors attachable to inlet connections of the two side chambers.

4. A mattress as claimed in claim 3 wherein the manifold conduit is connected to the source of air under pressure through control apparatus including a microprocessor which operates selectively to vary the pressure of air supplied to the manifold and/or to maintain within the mattress a required air pressure.

5. A mattress as claimed in claim 1 wherein means are provided for interrupting sequentially the supply of air under pressure to the two side chambers to increase and decrease alternately the pressure in each of the side chambers.

6. A mattress as claimed in claim 1 wherein the containment envelope comprises upper and lower sheets joined together by a plurality of transverse partitions to define elongate pockets within each of which is positioned one of the air sacks.

* * * * *

UNITED STATES PATENT AND TRADEMARK OFFICE

CERTIFICATE OF CORRECTION

PATENT NO. : 5,755,000

DATED : May 26, 1998

INVENTOR(S) : Martin Stuart Thompson

It is certified that error appears in the above-identified patent and that said Letters Patent is hereby corrected as shown below:

Col. 1, line 18, delete "ad", insert --and--

Col. 2, line 20, delete "pre-sat", insert --pre-set--

Col. 2, line 21, delete "an", insert --on--

Col. 2, line 26, delete "Interior", insert --interior--

Col. 2, line 29, delete "off", insert --of,--

Col. 3, line 35, delete "am", insert --an--

Col. 3, line 46, delete "manifold conduit is", insert --manifold conduit 15--

UNITED STATES PATENT AND TRADEMARK OFFICE

CERTIFICATE OF CORRECTION

PATENT NO. : 5,755,000

DATED : May 26, 1998

INVENTOR(S) : Martin Stuart Thompson

It is certified that error appears in the above-identified patent and that said Letters Patent is hereby corrected as shown below:

Col. 3, line 58, delete "which", insert --with--

Col. 3, line 59, delete "a", insert --as--

Col. 3, line 60, delete "chamber,", insert --chambers--

Col. 4, line 1, delete "driver", insert --driven--

Col. 4, line 4, delete "give", insert --given--

Col. 4, line 11, delete "trough", insert --through--

Col. 4, line 11, delete "outset pipe 16", insert --outlet pipe 16--

Col. 4, line 22, delete "sat", insert --set--

Col. 4, line 30, delete "af", insert --of--

Signed and Sealed this

Seventeenth Day of August, 1999

*Attest:*

*Attesting Officer*

Q. TODD DICKINSON

*Acting Commissioner of Patents and Trademarks*